US008807215B2

(12) United States Patent
Holderman et al.

(10) Patent No.: US 8,807,215 B2
(45) Date of Patent: Aug. 19, 2014

(54) METHOD AND APPARATUS FOR REMOTE ZONAL STIMULATION WITH FLUID LOSS DEVICE

(75) Inventors: Luke W. Holderman, Plano, TX (US); Jean Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/880,112

(22) PCT Filed: Aug. 3, 2012

(86) PCT No.: PCT/US2012/049433
§ 371 (c)(1), (2), (4) Date: May 16, 2013

(87) PCT Pub. No.: WO2014/021899
PCT Pub. Date: Feb. 6, 2014

(65) Prior Publication Data
US 2014/0034308 A1 Feb. 6, 2014

(51) Int. Cl.
*E21B 43/12* (2006.01)
*E21B 34/08* (2006.01)

(52) U.S. Cl.
CPC ..... *E21B 34/08* (2013.01)
USPC ..... 166/269; 166/279; 166/373; 166/306; 166/313

(58) Field of Classification Search
USPC ..... 166/313, 306, 269, 279, 373
See application file for complete search history.

(56) References Cited

U.S. PATENT DOCUMENTS

| | | | | |
|---|---|---|---|---|
| 4,962,815 | A * | 10/1990 | Schultz et al. | 166/387 |
| 7,559,375 | B2 | 7/2009 | Dybevik et al. | |
| 7,581,596 | B2 * | 9/2009 | Reimert et al. | 166/386 |
| 7,870,906 | B2 | 1/2011 | Ali | |
| 2006/0124310 | A1 * | 6/2006 | Lopez de Cardenas et al. | 166/313 |
| 2008/0210429 | A1 | 9/2008 | McMillin et al. | |
| 2011/0192613 | A1 | 8/2011 | Garcia et al. | |

OTHER PUBLICATIONS

Written Opinion for PCT Application No. PCT/US2012/049433 dated Feb. 27, 2013.
International Search Report for PCT Application No. PCT/US2012/049433 dated Feb. 27, 2013.

* cited by examiner

*Primary Examiner* — Kenneth L Thompson
*Assistant Examiner* — Ronald Runyan
(74) *Attorney, Agent, or Firm* — John W. Wustenberg; Booth Albanesi Schroeder, LLC

(57) ABSTRACT

Methods and apparatus for running a completion string with sand screen assemblies through multiple zones are presented allowing sequential stimulation of zones, and production without multiple trips. An exemplary method includes running a completion string and isolating target zones. If desired, the formation can be produced prior to stimulation. To stimulate the zones, a first tubing valve is closed, for example by ball-drop, forcing fluid through the first screen assembly. After stimulating the zone is complete, a first screen valve is closed by increased tubing pressure. The first work string valve is re-opened by further increasing tubing pressure. A subsequent tubing valve is then closed, for example, by flowing the ball to the next ball seat. The process is repeated until all zones are stimulated. Valves are then opened at each screen assembly to allow production flow through the screen assemblies.

20 Claims, 8 Drawing Sheets

$P_1 > P_2$ $P_2 > P_1$ $P_2 - P_1 >$ SHEAR FORCE

METHOD AND APPARATUS FOR REMOTE ZONAL STIMULATION WITH FLUID LOSS DEVICE

CROSS-REFERENCE TO RELATED APPLICATIONS

None.

FIELD OF INVENTION

Methods and apparatus for treating a subterranean well are presented. More specifically, methods and apparatus are presented for running a completion work string with a plurality of sand screen assemblies through multiple target zones, sequentially acidizing or stimulating the target zones through the screen assemblies, and then producing the well without multiple trips.

BACKGROUND OF INVENTION

It is typical in hydrocarbon wells to stimulate, that is fracture, acidize, or otherwise work-over the formation or wellbore after initial drilling is complete and often after production has occurred. Additionally, and especially in long horizontal wellbores, it is desirable to stimulate a series of zones of the formation sequentially. Where production tubulars are in place, it may be necessary to remove the production string to perform the stim operations. Similarly, after completion of the stim operations, it is typical to pull the work string and then run a separate completion string prior to prolonged production. Completion strings typically include sand screen assemblies, which are known in the art.

There is a need for methods and apparatus for allowing a single-trip for stimulation and production. More particularly, there is a need for these methods and apparatus for zonal stimulation and production. More particularly, there is a need for a production string having sand screen assemblies with the ability to stimulate through the sand screen assemblies and then produce through the same assemblies.

SUMMARY OF THE INVENTION

Methods and apparatus for treating a subterranean well are presented. More specifically, methods and apparatus are presented for running a completion work string with a plurality of sand screen assemblies through multiple target zones, sequentially acidizing or stimulating the target zones through the screen assemblies, and then producing the well without multiple trips.

In a preferred embodiment, a method is presented including running into the hole a work string having an interior passageway and a plurality of longitudinally-spaced screen assemblies. Each screen assembly is positioned adjacent a corresponding target zone of the formation. The target zones are isolated, such as with swellable packers. If desired, the formation can be produced through the screen assemblies prior to actuating the various valves described below. A first valve is closed, blocking flow through the interior passageway, and forcing fluid through the first screen assembly into the first target zone. After acidizing or stimulating the formation through the screen assembly, a first screen valve is closed by increasing fluid pressure in the tubing. The first work string valve is opened by further increasing tubing pressure. A second work string valve is then closed. For example, a ball is dropped and sequentially closes ball seat valves at deeper screen assemblies. The process can be repeated for multiple zones. Once acidizing is complete, valves are opened to allow flow through the screen assemblies, allowing production of the target zones.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention. The description is provided with reference to a vertical wellbore; however, the inventions disclosed herein can be used in horizontal, vertical or deviated wellbores.

Figure 1:
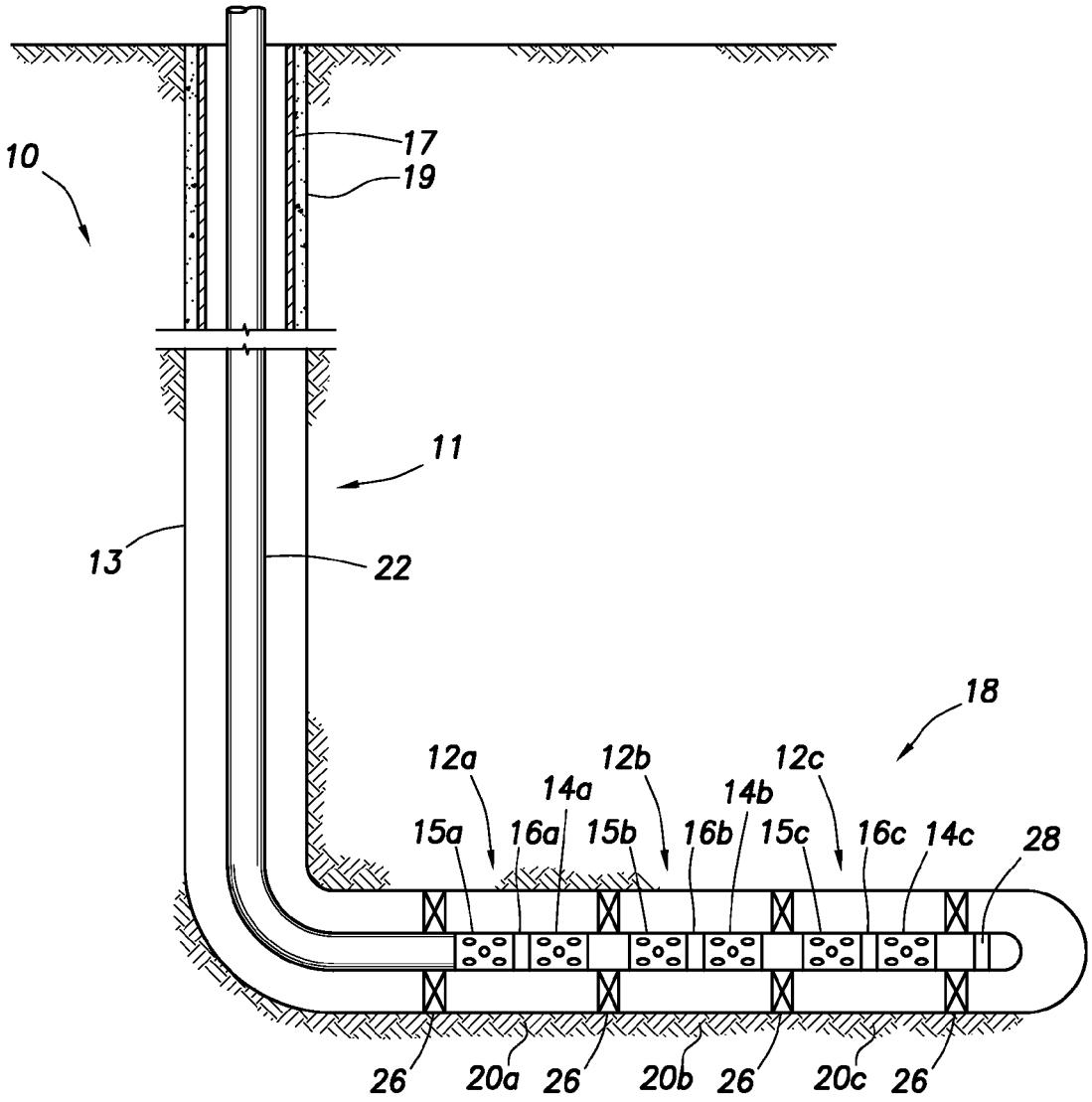
FIG. 1 is a schematic illustration of a well system including a work string having a plurality of tubing sections for use in completion and stimulation of formation.

FIG. 1 is a schematic illustration of a well system, indicated generally 10, including a work string 22 having a plurality of tubing sections 12 for use in completion and stimulation of formation. The terms stimulation and injection, as used herein, are meant to include fracking, acidizing, hydraulic work and other work-overs. In a preferred embodiment, each tubing section 12 includes at least one screen assembly 14 and a flow control assembly 16. The sections can include multiple such assemblies as well as blank tubing, perforated tubing, shrouds, joints, etc., as are known in the industry. A wellbore 13 extends through various earth strata. Wellbore 13 has a substantially vertical section 11, the upper portion of which has installed therein casing 17 held in place by cement 19. Wellbore 13 also has a substantially deviated section 18, shown as horizontal, that extends through a hydrocarbon bearing subterranean formation 20. As illustrated, substantially horizontal section 18 of wellbore 12 is open hole. It is understood that the wellbore may be cased or open, vertical, horizontal, or deviated, etc.

Positioned within wellbore 13 and extending from the surface is a work string 22. Work string 22 provides a conduit for formation fluids to travel from formation 20 upstream to the surface and for fluids to be pumped down into the wellbore. Positioned along work string 22 adjacent the various target zones 20*a-c* are a plurality of screen assemblies 14*a-c* and 15*a-c*, and a plurality of flow control assemblies 16*a-c*. Isolation devices 26 such as packers provide a fluid seal between the work string 22 and the wellbore 13. Adjacent packers 26 straddle target zones 20*a-c* of the formation. The packers isolate the target zones for stimulation and production. The packers are preferably swellable packers, however, they may be other types of packers as are known in the industry, for example, slip-type, expandable or inflatable packers. Additional downhole tools or devices may also be included on the work string, such as valve assemblies, for example at valve 28, safety valves, inflow control devices, check valves, etc., as are known in the art.

In the illustrated embodiment, each of the work string sections 12 provides sand control capability with at least one sand screen assembly 14. The screen assembly, and the screen elements or filter media therein, are designed to allow fluids to flow therethrough but prevent particulate matter of sufficient size from flowing therethrough. The exact design of the screen assembly and screen elements is not critical to the present invention as long as it is suitably designed for the characteristics of the formation fluids and any treatment operations to be performed. For example, the sand control screen may utilize a non-perforated base pipe having a wire wrapped around a plurality of ribs positioned circumferentially around the base pipe that provide stand-off between the base pipe and the wire wrap. Alternatively, a fluid-porous, particulate restricting, sintered metal material such as a plurality of layers of a wire mesh that are sintered together to form a fluid porous wire mesh screen could be used as the filter medium. Sand screen assemblies and filter elements are commercially available, such as from Purolator (trade name) which makes Poromax (trade name) and Poroplus (trade name) screens, from MKI, Inc., or Petroguard (trade name) screens from Halliburton Energy Services, Inc. As illustrated, a protective outer shroud having a plurality of perforations therethrough may be positioned around the exterior of the filter medium. As shown, adjacent each target zone 20 is positioned a screen assembly 14 and flow control assembly 16. Alternately, multiple screen assemblies and multiple flow control assemblies may be positioned adjacent any one target zone. Further, multiple sand screen assemblies can be used along a target zone, with a single associated flow control assembly for controlling fluid flow through the multiple screen assemblies.

Through use of the fluid selector assemblies 16 and screen assemblies 14, positioned and operable across a plurality of target zones, the operator has zonal control over fluid flow for zonal stimulation and, without requiring additional pull out of hole or run in hole operations, control to allow production of fluids after stimulation. Additionally, in a preferred embodiment, the system allows for production from the zones prior to stimulation operations.

Figure 2:
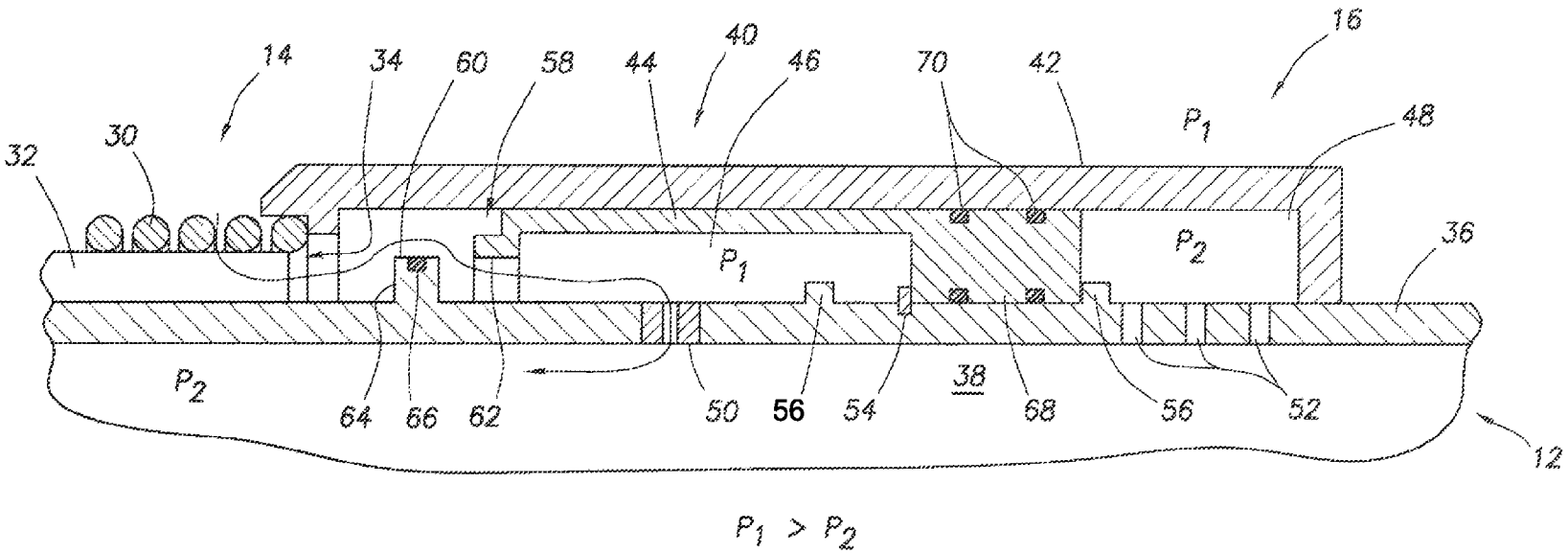
FIG. 2 is a cross-sectional, partial schematic of a work string section having screen assemblies and a flow control assembly according to an aspect of the invention indicating a state of operation of the assemblies for production flow.
Figure 3:
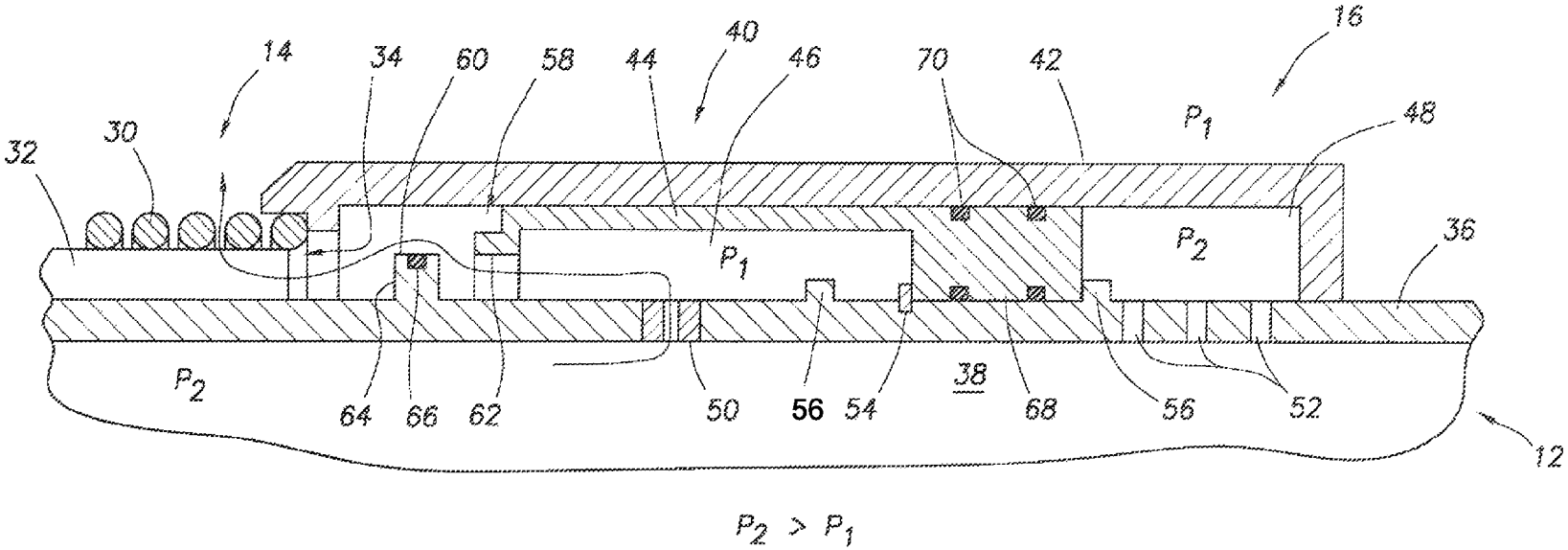
FIG. 3 is a cross-sectional, partial schematic of a work string section having a screen assembly and a flow control assembly according to an aspect of the invention indicating a state of operation of the assemblies for injection flow.
Figure 4:
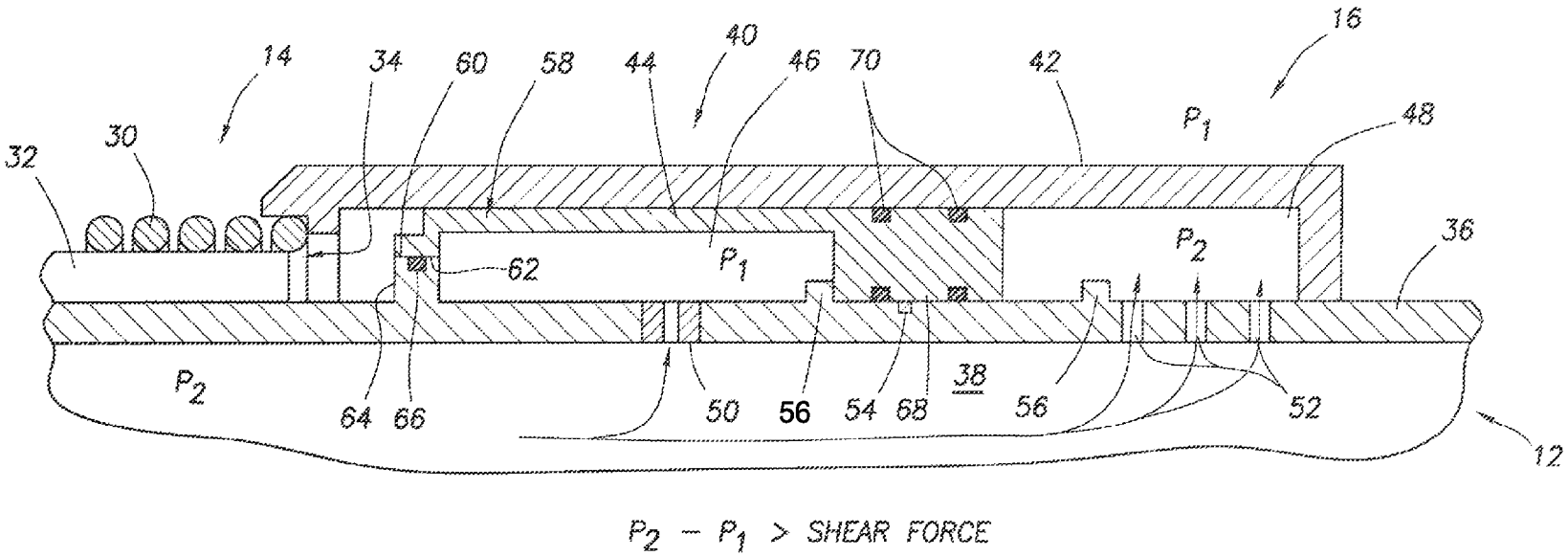
FIG. 4 is a cross-sectional, partial schematic of a work string section having a screen assembly and a flow control assembly according to an aspect of the invention in a closed or shut-off position.

FIGS. 2-4 are cross-sectional, partial schematics of a work string section 12 having a screen assembly 14 and a flow control assembly 16 according to an aspect of the invention indicating states of operation of the assemblies for production, injection or stimulation flow, and shut off of flow through the screen assembly.

FIG. 2 is a cross-sectional, partial schematic of a work string section 12 having a screen assembly 14 and a flow control assembly 16 according to an aspect of the invention indicating a state of operation of the assemblies for production flow. Generally, a wellbore tubular 36 having an interior passageway 38 for fluid flow is shown. The work string has a screen assembly 14 with a screen 30, a base pipe 32, and a screen port(s) 34 providing a fluid path between the exterior and interior passageway 38 of the work string. Fluid flowing through the screen port 34 flows through the screen 30. The operation and configuration of sand screen assemblies will not be described in detail herein. Sand screen assemblies are well known in the art and commercially available.

A flow control assembly 16 includes a tubing-pressure operated injection control valve 40 for controlling fluid flow through the screen assembly. The valve 40, in a preferred embodiment, includes a housing 42 defining an annular space 43 between the housing and the tubular 36, a sliding sleeve 44 positioned in the annular space 43 an forming a first and second pressure chambers 46 and 48, injection port(s) 50, and closure port(s) 52. The valve 40 is seen in an open position in FIG. 2, with formation fluid F flowing along the indicated path from the formation to the interior passageway 38 of the tubular 36. In such a configuration and use, the pressure in the first pressure chamber 46 is greater than the pressure in the chamber 48. The sliding sleeve 44 is maintained in an open position by a shear mechanism 54, such as one or more shear pins, selected to shear at a first pressure. Additionally, the sliding sleeve is held in position by limiter 56, such as a shoulder, pin or pins, snap ring, etc. The sliding sleeve 44 includes a valve element 58 which cooperates with a valve seat 60 when the valve is in the closed position. The valve element is shown, in a preferred embodiment, having a circumferential lip 62 extending inwardly from the sliding sleeve 44. The valve element 58 cooperates with valve seat 60, shown as an annular or circumferential ridge 64 extending from the tubular wall 36. The valve seat preferably includes seal elements 66. Additional seal elements can be employed at the valve element and valve seat.

The sliding sleeve 44 operates in a manner known in the art, sliding longitudinally along the housing and tubular. The sleeve is initially held in an open position, as seen in FIG. 2. The sleeve 44 operates as a piston, having a head 68 positioned between the pressure chambers 46 and 48. Seals 70 are preferred. Fluid flow into the pressure chamber 48 flows through one or more ports 52. One or more injection ports 50 allow fluid flow between the interior passageway of the tubular and the chamber 46. The injection port is selected to control the rate of fluid flow therethrough or the fluid pressure differential across the injection port. This control can be accomplished through the relative sizes, number, and shapes of the injection port 50 and chamber ports 52. For example, the injection port 50 preferably comprises a nozzle. The port can comprise one or more nozzles, autonomous fluid control devices, tortuous paths, etc.

In use, production fluid from the formation flows into the screen assembly 14, through the screen 30, and through the one or more screen port 34. Fluid then flows into and through the open valve 40. More particularly, fluid flows through the opening between the valve element 58 and the valve seat 60 and into first pressure chamber 46. Flow continues through the injection port 50 and into the interior passageway 38 of the tubular. Fluid is also allowed to flow into pressure chamber 48 from the interior passageway through ports 52. The injection port 50, which acts as a nozzle or flow restrictor, creates a pressure differential across the valve assembly, such that pressure in the chamber 46 is greater than pressure in the chamber 48. The sleeve is maintained in position by limiter 56. The flow control port 50 can be a nozzle, any number of flow chokes, be friction based, a tube, or an autonomous inflow control device for example.

FIG. 3 is a cross-sectional, partial schematic of a work string section 12 having a screen assembly 14 and a flow control assembly 16 according to an aspect of the invention indicating a state of operation of the assemblies for injection flow. When it is desired to inject fluid into the formation or wellbore, such as when stimulating, acidizing, fracking, etc., fluid is pumped down the interior passageway 38 and along the indicated path through the valve 40, screen assembly 14 and into the wellbore. Again, fluid flow is restricted or controlled through the port 50, creating a pressure differential across the valve 40. Consequently, the pressure in the interior passageway and second chamber 48 are greater than the pressure in first chamber 46. Nevertheless, the sliding sleeve remains in place due to shear pin 54.

FIG. 4 is a cross-sectional, partial schematic of a work string section 12 having a screen assembly 14 and a flow control assembly 16 according to an aspect of the invention in a closed or shut-off position. When injection operations are complete and it is desired to close the valve 40, tubing pressure is increased. Pressure rises in the second chamber 48 to greater than that in chamber 46, creating a pressure differential across the head 68. When the pressure differential is great enough, the shear pin 54 shears at a preselected shear force. For example, the shear pin can be selected to shear at 1000 psi.

Figure 5:
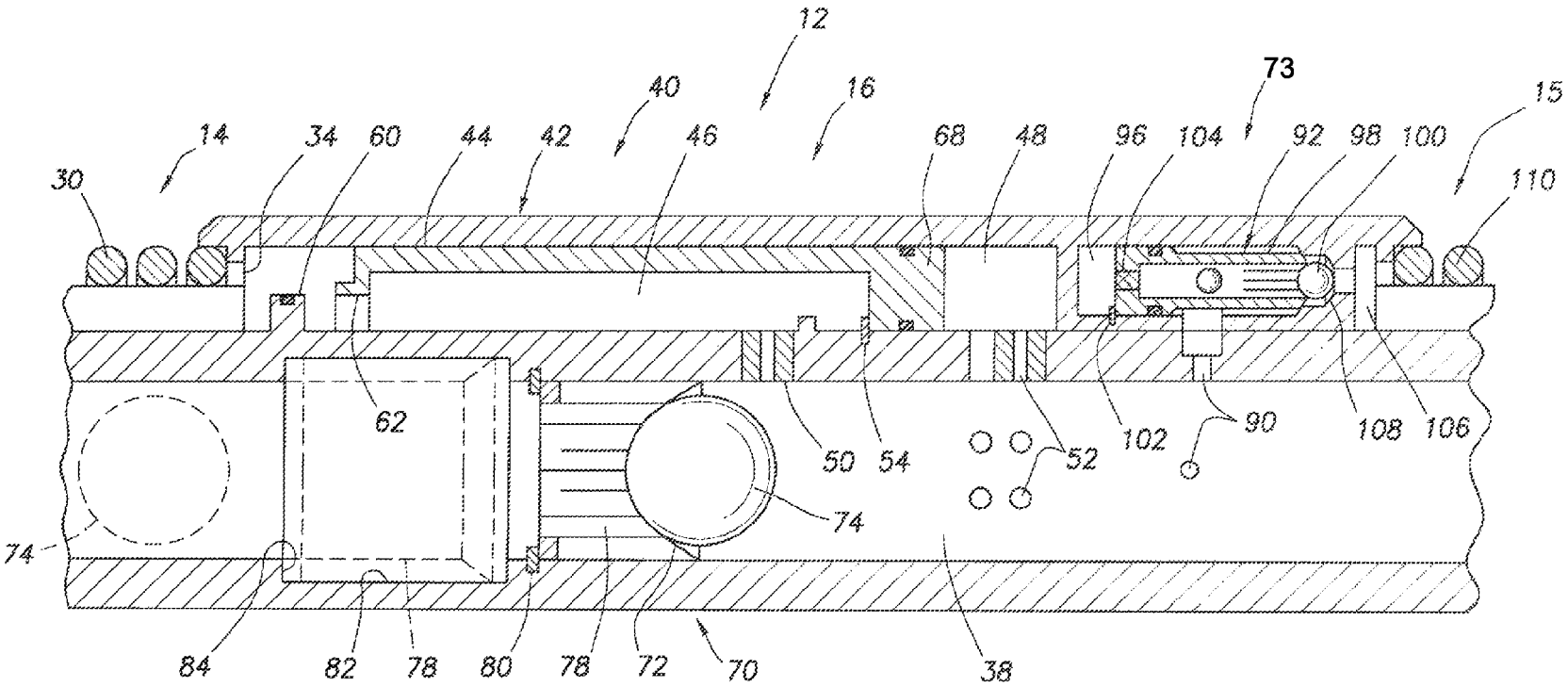
FIG. 5 is a cross-sectional partial schematic of an exemplary flow control assembly having a bore valve assembly, an injection valve and a remote-open valve.

FIG. 5 is a cross-sectional partial schematic of an exemplary flow control assembly having a bore valve assembly 70, an injection valve 40 and a remote-open valve assembly 73. In a preferred embodiment, the assembly further includes a bore valve assembly 70 operable to restrict fluid flow through the interior passageway 38. Persons of skill will recognize that various designs for bore valves can be employed. In a preferred embodiment, the bore valve is a drop-ball valve, as shown. A valve seat 72 receives a dropped or pumped-in ball 74 (or other-shaped valve element) from uphole thereby blocking fluid flow through the interior passageway. The valve seat 72 is shown as part of a collet assembly 76 having a seat 72, a radially expandable and longitudinally slidable collet 78, shear mechanisms 80, and a cooperating recess 82. After production of the formation (if any) through the injection valve 40, when it is desirable to stimulate the formation, the bore valve is closed, such as by dropping ball 74 into the interior passageway, where it moves to the position shown in FIG. 5.

FIG. 5 shows the assembly in position for stimulation or injection procedures, with the injection valve 40 in an open position and the bore valve 70 closed by the ball 74 positioned on the valve seat 72. With fluid flow through the passageway restricted, injection fluids are forced out through the injection valve 40 and screen assembly 14 as explained above. Additional screen assemblies can be employed simultaneously for injection, either above or below the assembly 14 seen on the left in the Figure, with a single bore valve controlling fluid flow outward through multiple screen assemblies.

As explained above and as seen in FIG. 4, upon completion of stimulation operations, the injection valve 40 is closed. Tubing pressure is then increased until the shear pins 80 shear allowing the slidable collet 78 to move longitudinally. The bore valve shear elements are designed to shear at a preselected shear force. For example, the shear force can be 2000 psi. When the collet moves adjacent the recess 82, it expands radially, enlarging the diameter of the valve seat 72 to allow the ball 74 to pass through the valve. The collet is prevented from further longitudinal movement by motion limiter 84, here a shoulder. The bore valve 70 is now in the open position, with the collet and ball moved to the positions indicated by the dashed lines.

Initially, the work string is run in hole, positioned, and the target zones isolated, such as with swellable packers 26. The well can be produced once in position, if desired. The stimulation procedure described above is then performed sequentially at the target zones 14*a-c*. For example, in FIG. 1, the flow control assembly 16*a* of tubing section 12*a* may be initially open to production flow from the formation. When it is desired to undergo injection operations in target formation 20*a*, the injection valve 40 of the control assembly 16*a* is closed by dropping a ball to seat upon the bore valve seat. Fluid is restricted from flowing down the interior passageway and is forced into the formation through the injection valve assembly 40 and screen assembly 14. Upon completion of stimulation of the target zone 20*a*, the tubing pressure or flow rate is increased until the shear pins 54 of the injection valve shear and the injection valve is closed. Tubing pressure is then increased until shear pins 80 of the bore valve are sheared. The collet 78 slides longitudinally and, upon reaching cooperating recess 82, expands radially, allowing the ball 74 to pass through the bore valve. The ball is then moved downhole to section 12*b* with screen assembly 14*b* and control assembly 16*b* where the stimulation and bore valve opening process are repeated. Similarly, the process can be repeated at section 12*c* and further sections until all the target zones are stimulated or treated.

When the final zone is completed, it is desirable to then open all of the target zones to production. As seen again in FIG. 5, the flow control assembly 16 of tubing section 12 further includes a remote-open valve assembly 73. The remote-open valve assembly 73 includes an inlet port 90, a collet assembly 92 slidable in a housing chamber 96 and expandable in a recess 98, a valve element 100 (here a ball), a shear mechanism 102, a magnet 104, a valve seat 108, and a screen flow port 106 in fluid communication with a screen 110 of screen assembly 15. In use, after completion of the zonal stimulation operations, tubing pressure is increased to actuate the remote-open valve. Tubing pressure is increased in the interior passageway and communicates through remote-valve inlet port(s) 90 into the collet assembly 92. The valve element 100 is maintained on the valve seat 108 by the tubing pressure and is prevented from longitudinal movement to the opposite side of the inlet port 90 by the upper end of the collet assembly 92. The valve element remains seated while tubing pressure is applied, thereby assuring that all remote-open valves are opened, and unseats when tubing pressure is dropped. Multiple remote-open valves can be used per flow control assembly, per section and per work string. When sufficient pressure differential is applied across the collet assembly, that is between the interior space of the collet, which is closed at its lower end, and the housing chamber 96, the shear mechanism, here pins 102, shear. For example, the shear pins can be designed to shear at 3000 psi. The collet slides longitudinally until adjacent the recess 98, where it expands radially into the recess. The collet now has an open diameter to allow the ball to pass through. Tubing pressure is decreased and the ball 100 moves off valve seat 108 and toward the magnet 104. The magnet holds the ball in position. The screen flow port 106 is now open and production through screen assembly 15, screen 110, and screen port 106, the remote-open valve assembly, inlet ports 90 and the interior passageway 38.

Note that in a preferred embodiment, the zonal stimulation method using the drop-ball bore valves is self-regulating. Initially, permeability will be low in the reservoir, and the pressure drop across the assembly will be effectively determined by the permeability, thereby keeping acid flow rates low. Once the rock breaks down and permeability increases, the pressure drop will be effectively regulated by the flow control ports or nozzles. Pressure in the tubular will spike and automatically shut the valve. In essence the operator will only have to set a flow rate and let the tool do the rest.

Remote-open valve units are commercially available from Halliburton Energy Services, Inc. Incorporated herein by reference for all purposes are U.S. patent application Ser. Nos. 13/045,800 and 13/041,611 to Veit, filed Mar. 11, 2011 and Mar. 7, 2011; *Petroguard Screen and EquiFlow ICD with Remote Open Valve*, Halliburton Completion Tools, Advanced Completions (2011) (available on-line); and *Single-Trip Gravel Pack and Treat System*, Halliburton Completion Tools, Sand Control (2011) (available on-line). As indicated in these disclosures, the remote-open valve assembly can further include inflow control devices (ICD) if desired.

Figure 6:
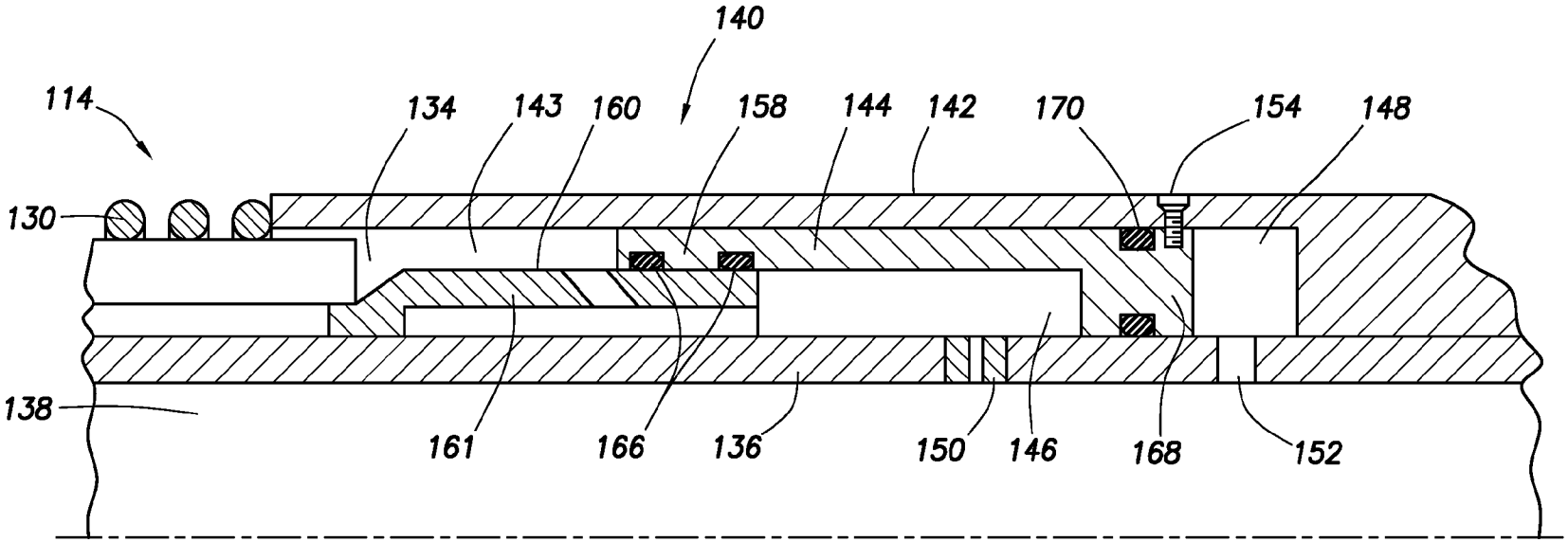
FIG. 6 is a cross-sectional partial schematic of an alternate embodiment of an injection valve assembly for use in accordance with the invention.

FIG. 6 is a cross-sectional partial schematic of an alternate embodiment of an injection valve assembly 140 for use in accordance with the invention. The alternate injection valve 140 provides protection for the valve seals during run in and operation. A flow control assembly includes a tubing-pressure operated injection control valve 140 for controlling fluid flow through the screen assembly. The valve 140 includes a housing 142 defining an annular space 143 between the housing and the tubular 136, a sliding sleeve 144 positioned in the annular space 143 an forming a first and second pressure chambers 146 and 148, injection port(s) 150, and closure port(s) 152. The valve 140 is seen in an open position in FIG. 6, with fluid allowed to flow between the formation and the interior passageway 138 of the tubular 136. During production while in the open position, the pressure in the first pressure chamber 146 is greater than the pressure in the chamber 148. The sliding sleeve 144 is maintained in an open position by a shear mechanism 154, such as one or more shear pins. The sliding sleeve 144 includes a valve element 158 which cooperates with a valve seat 160 when the valve is in the closed position. The valve element 158 cooperates with the valve seat 160, which is positioned on a valve seat arm 161 extending from the tubular wall 136. The valve element includes seal elements 166, preferably molded seals.

The sliding sleeve 144 operates in a manner similar to that discussed above. The sleeve is initially held in an open position. The sleeve 144 operates as a piston, having a head 168 positioned between the pressure chambers 146 and 148. Seals 170 are preferred. Fluid flow into the pressure chamber 148 flows through one or more ports 152. One or more injection ports 150 allow fluid flow between the interior passageway of the tubular and the chamber 146. The injection port is selected to control the rate of fluid flow therethrough or the fluid pressure differential across the injection port. This control can be accomplished through the relative sizes, number, and shapes of the injection port 150 and chamber ports 152. For example, the injection port 152 preferably comprises a nozzle. The port can comprise one or more nozzles, autonomous fluid control devices, tortuous paths, etc.

In use, production fluid from the formation flows into the screen assembly 114, through the screen 130, and through the one or more screen port 134. Fluid then flows into and through the open valve 140. More particularly, fluid flows through the opening between the valve element 158 and the valve seat 160 and into first pressure chamber 146. Flow continues through the injection port 150 and into the interior passageway 138 of the tubular. Fluid is also allowed to flow into pressure chamber 148 from the interior passageway through ports 152. The injection port 150, which acts as a nozzle or flow restrictor, creates a pressure differential across the valve assembly, such that pressure in the chamber 146 is greater than pressure in the chamber 148.

When it is desired to inject fluid into the formation or wellbore, such as when stimulating, acidizing, fracking, etc., fluid is pumped down the interior passageway 138 and through the valve 140, screen assembly 114 and into the wellbore. Again, fluid flow is restricted or controlled through the port 150, creating a pressure differential across the valve 140. Consequently, the pressure in the interior passageway and second chamber 148 are greater than the pressure in first chamber 146. Nevertheless, the sliding sleeve remains in place due to shear pin 154. When stimulation is complete, the valve is moved to a closed or shut-off position. Tubing pressure is increased in the second chamber 148 to greater than that in chamber 146, creating a pressure differential across the head 168. When the pressure differential is great enough, the shear pin 154 shears at a preselected shear force. The sliding sleeve 144 then slides longitudinally until the seal elements 166 straddle the valve seat, thereby sealing fluid flow through the valve.

Figure 7:
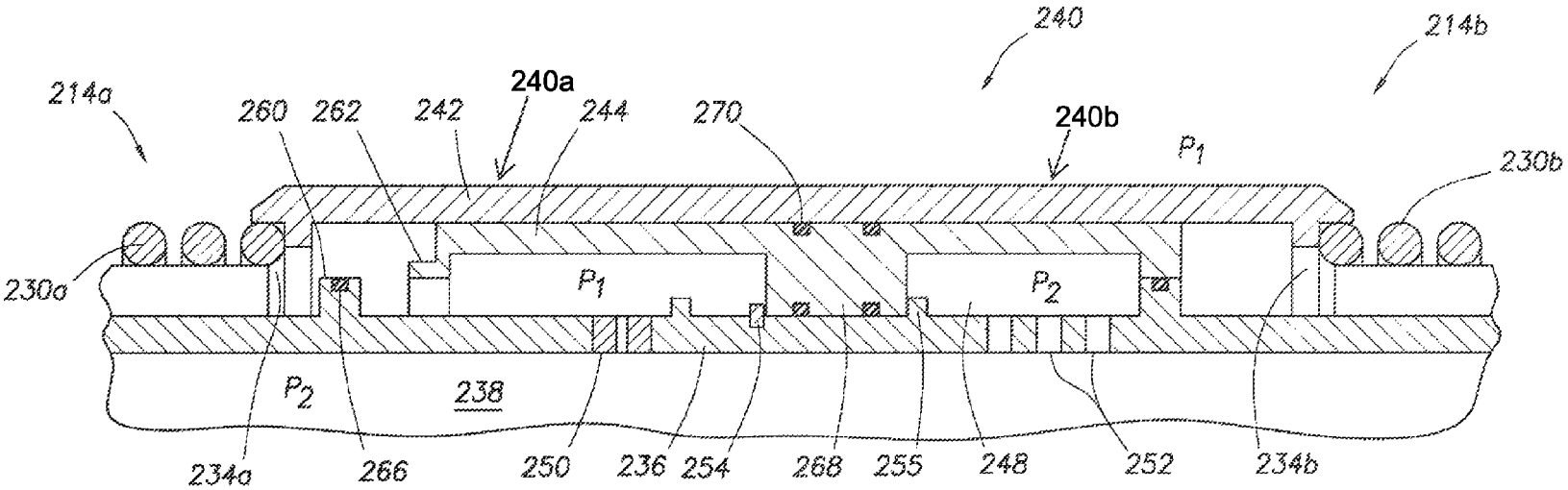
FIG. 7 is a cross-sectional partial view of an embodiment of an aspect of the invention acting as an inflow control device (ICD) with a shifting sleeve valve movable to allow greater inflow and operable by tubing flow rate.

FIG. 7 is a cross-sectional partial view of an embodiment of an aspect of the invention acting as an inflow control device (ICD) with a shifting sleeve valve movable to allow greater inflow and operable by tubing flow rate. In this embodiment, the valve 240 includes elements similar to those described above, so details will not be repeated here. The valve assembly 240 has two valves, 240*a* and 240*b*, each of which regulate flow between the interior passageway of the tubular and the formation. In an initial configuration, seen in FIG. 7, production is allowed through valve 240*a*, with production flow regulated by the one or more flow control ports 250. When it is desirable to allow greater production flow rate, the valve 240*a* is closed and the valve 240*b* is opened. Flow through valve 240*b* is regulated by the one or more ports 252, which allow a greater flow rate than ports 250. Consequently, the valve assembly 240 acts as an ICD when in the initial position, allowing a preselected initial flow rate or volume of production, which rate may be dependent on the characteristics of the production fluid and may change as those characteristics change. When desired, the operator can close valve 240*a* and open valve 240*b*, allowing a greater amount of flow (rate or volume), and again dependent on the characteristics of the fluid. With the valve 240*b* open, the assembly can be considered to be a "full open" position, and the valve 240*b* the "full open" valve. While this implies substantially no flow restriction through the ports 252, alternative embodiments may still provide flow restriction, but are less restrictive than flow control port 250.

As an example of assembly use, the valve assembly 240 can be run in to hole and the formation produced with the valve 240*a* open, acting as an ICD. When the water cut of produced fluid reached a selected amount, say 95 percent, the valve 240*b* can be opened to allow a large pull-down in an effort to produce the remaining hydrocarbons in the formation.

The valves 240*a-b* are opposing valves, that is, when one is open the other is closed. The valve 240a has a housing 242, a sliding sleeve 244 which operates a valve element 262 to seal against valve seat 260 which preferably includes seal elements 266. Two pressure chambers 246 and 248 are defined on either side of piston head 268, with fluid communication from the interior passageway 238 of the tubular 236 to the first chamber 246 through port 250 which acts as a flow regulator, such as a nozzle. Piston head 268 has seals 270 to seal against unwanted fluid flow. Fluid communication to chamber 248 from the interior passageway is through one or multiple ports 252 which allow (when the valve is open for production through screen assembly 214b) for greater fluid flow rate than the nozzle 250.

Valve assembly 240 is movable between a first open position, seen in FIG. 7, and a second position. In the first or initial position, production fluid flows through the screen assembly 214*a*, screen port 234*a*, chamber 246, and flow control port or nozzle 250, into the interior passageway. Flow is restricted by the port 250. To move the valve assembly 240 to a full open or second position, fluid s pumped through the interior passageway and through port 250, creating a pressure differential between chambers 246 and 248. The shear mechanism 254 shears, allowing the piston head 268 to move longitudinally. This closes valve 240*a* as explained above. The movement also opens valve 240*b*, thereby allowing production through screen assembly 214*b*, screen 230*b*, and screen port 234*b* into chamber 248 and into the interior passageway via ports 252. The valve 240*b* is similar to valve 240*a*, wherein the sliding sleeve 244 includes a second valve element 262*b* which cooperates with a second valve seat 260*a* and second seal 266*a*.

Figure 8:
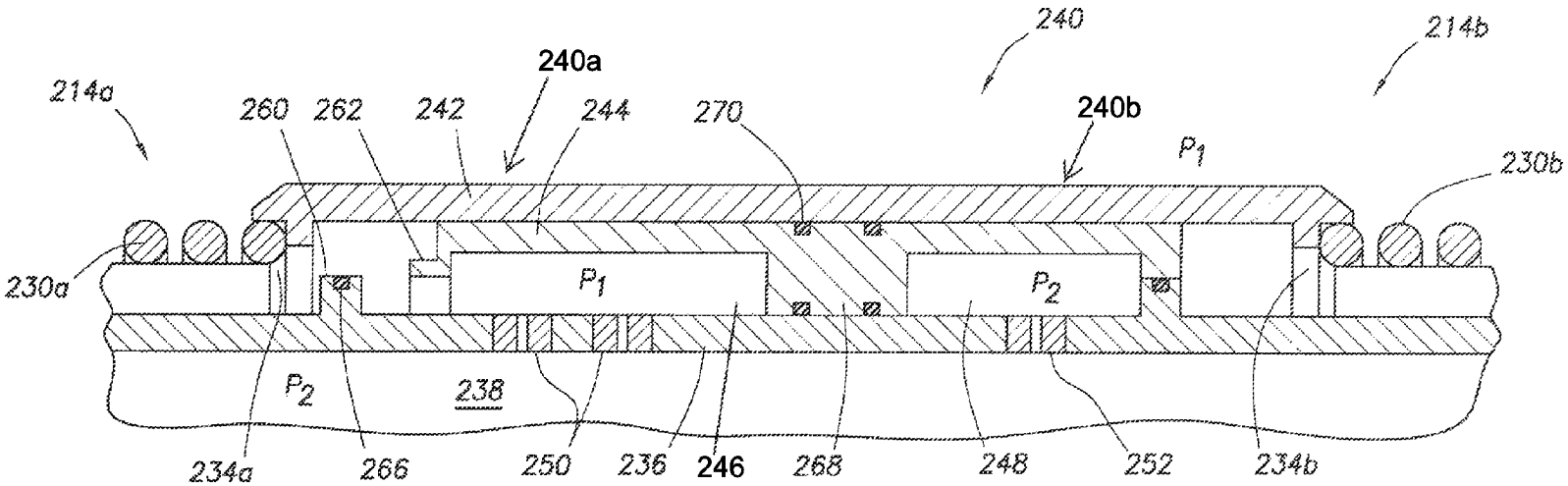
FIG. 8 is a cross-sectional partial view of an embodiment of an aspect of the invention acting as an inflow control device (ICD) with a shifting sleeve valve movable to alter production inflow and operable by tubing flow rate.

FIG. 8 is a cross-sectional partial view of an embodiment of an aspect of the invention acting as an inflow control device (ICD) with a shifting sleeve valve movable to alter production inflow and operable by tubing flow rate. Like numbers are used for like parts from FIG. 7. Consequently, the elements will not be described in detail. The valve assembly 240 again has two valves, 240*a* and 240*b*, each of which regulate flow between the interior passageway of the tubular and the formation. In an initial configuration, seen in FIG. 8, production is allowed through valve 240a, with production flow regulated by the one or more flow control ports 250. When it is desirable to reduce the production flow rate, the valve 240*a* is closed and the valve 240*b* is opened. Flow through valve 240*b* is regulated by the one or more ports 252, which may also be nozzles and flow control devices, which allow a lower flow rate than ports 250. Consequently, the valve assembly 240 acts as an ICD when in the initial position, allowing a preselected initial flow rate or volume of production, which rate may be dependent on the characteristics of the production fluid and may change as those characteristics change. When desired, the operator can close valve 240*a* and open valve 240*b*, allowing a lesser amount of flow rate or volume (and a higher pressure drop across the assembly), and again dependent on the characteristics of the fluid. This allows the operator to change the ICD rate without a tool run. For example, the operator can change the ICD "setting" in the well assuming there was not sufficient pressure drop with the ICD in the initial position.

In another embodiment, the operation can be reversed, where the pressure drop could be lessened to allow for less restriction in the event that the operator wanted to flow the well harder than planned. Such an embodiment can be achieved by reversing or otherwise changing the number, size, flow rates, etc., of the ports 250 and 252.

The embodiments detailed above are exemplary. Persons of skill in the art will recognize changes, alterations and design choices which can be made without departing from the spirit of the invention. The invention is defined by the claims. The remote-open valves discussed above, can also be check valves, ball check valves, spring biased, a rubber sleeve valve, a piston activated by swellable material, a time degradable plug (PLA or anhydrous boron) or a plugged screen. The expandable collet described above can be replaced by an expandable metal sleeve that the ball would pass through or by a rubber "rectum" which would flair and allow the ball to pass. Further, it is not necessary to run the ball stim valve system on every joint. You only need one per zone. The other joints could be ICDs, AICDs or just Stand Alone Screens with some type of check valve. Further, in an exemplary embodiment for shorter wells, the system could be run without the ball and collet system. The operator would simply run the sleeve as a pup joint add-on and bull head through all valves at once. To close the valves the operator simply increases pump rate to critical rate and the first valve would close (not necessarily the valve at the heel or toe but any valve in the string). Once this happens the pressure in the tubing would immediately increase and all the valves would subsequently close. Now all you would need is either check valves or remote open valves on your ICD or Stand Alone Screen joints that are accompanying each stimulation sleeve in each zone.

Exemplary methods of use of the invention are described, with the understanding that the invention is determined and limited only by the claims. Those of skill in the art will recognize additional steps, different order of steps, and that not all steps need be performed to practice the inventive methods described.

In preferred embodiments, the following methods are disclosed. A method of treating a subterranean well having a wellbore extending through a formation having a plurality of production zones, the method comprising the steps of: 1) running into the wellbore a work string having an interior passageway for flowing fluid within the work string, the work string having a plurality of longitudinally-spaced screen assemblies positioned thereon; 2) positioning each screen assembly adjacent a corresponding target zone of the formation; 3) isolating a plurality of target zones; 4) closing a first work string valve positioned in the interior passageway of the work string; 5) blocking fluid flow through the interior passageway and flowing fluid from the interior passageway through a first screen assembly and into the corresponding first target zone; 6) closing a first screen valve by increasing a fluid pressure differential across the first screen valve, thereby blocking fluid flow from the interior passageway into the formation through the first screen assembly; 7) opening the work string valve and allowing fluid flow along the interior passageway; and repeating steps 4) through 7) but with respect to a second work string valve, a second screen assembly and corresponding second target zone. The method can be repeated for multiple zones sequentially. Additional methods include additional steps or conditions, including: isolating a plurality of target zones using a plurality of packers; wherein the packers are swellable packers; wherein at least one packer is positioned uphole and downhole from each screen assembly; setting the packers using tubing string pressure; wherein the packers are set with work string pressure; closing the first work string valve using fluid flow or pressure in the interior passageway of the work string; moving a ball onto a ball seat to block fluid flow through the first work string valve; wherein the step of moving the ball further includes dropping the ball into the interior passageway of the work string; wherein step 5 further comprises the step of acidizing the formation; moving the ball onto a ball seat to block fluid flow through the second work string valve; raising fluid pressure in the interior passageway of the work string to open the second work string valve; shifting the ball seat longitudinally and expanding the ball seat radially to a diameter larger than the ball diameter; wherein the ball seat comprises a collet assembly; producing hydrocarbon-bearing fluid from the wellbore; producing hydrocarbon-bearing fluid from the wellbore between steps 2 and 3; flowing fluid at a relatively slower flow rate through a flow choke providing fluid communication between the wellbore and interior passageway, and flowing fluid at a relatively higher flow rate into a piston reservoir of the first screen valve; wherein the flow choke further comprises a nozzle, an autonomous in-flow device, or a check valve; opening a plurality of remote-open valves associated with the plurality of screen assemblies; and further comprising the steps of increasing fluid pressure in the interior passageway and then decreasing fluid pressure in the interior passageway to open the remote-open valves.

Descriptions of fluid flow control using autonomous inflow control devices (AICD) and their application can be found in the following U.S. Patents and Patent Applications, each of which are hereby incorporated herein in their entirety for all purposes: U.S. patent application Ser. No. 12/770,568, entitled "Method and Apparatus for Controlling Fluid Flow Using Movable Flow Diverter Assembly," to Dykstra, filed Apr. 29, 2010; U.S. patent application Ser. No. 12/700,685, entitled "Method and Apparatus for Autonomous Downhole Fluid Selection With Pathway Dependent Resistance System," to Dykstra, filed Feb. 4, 2010; U.S. patent application Ser. No. 12/791,993, entitled "Flow Path Control Based on Fluid Characteristics to Thereby Variably Resist Flow in a Subterranean Well," to Dykstra, filed Jun. 2, 2010; U.S. patent application Ser. No. 12/792,117, entitled "Variable Flow Resistance System for Use in a Subterranean Well," to Fripp, filed Jun. 2, 2010; U.S. patent application Ser. No. 12/792,146, entitled "Variable Flow Resistance System With Circulation Inducing Structure Therein to Variably Resist Flow in a Subterranean Well," to Dykstra, filed Jun. 2, 2010; U.S. patent application Ser. No. 12/879,846, entitled "Series Configured Variable Flow Restrictors For Use In A Subterranean Well," to Dykstra, filed Sep. 10, 2010; U.S. patent application Ser. No. 12/869,836, entitled "Variable Flow Restrictor For Use In A Subterranean Well," to Holderman, filed Aug. 27, 2010; U.S. patent application Ser. No. 12/958,625, entitled "A Device For Directing The Flow Of A Fluid Using A Pressure Switch," to Dykstra, filed Dec. 2, 2010; U.S. patent application Ser. No. 12/974,212, entitled "An Exit Assembly With a Fluid Director for Inducing and Impeding Rotational Flow of a Fluid," to Dykstra, filed Dec. 21, 2010; U.S. patent application Ser. No. 12/966,772, entitled "Downhole Fluid Flow Control System and Method Having Direction Dependent Flow Resistance," to Jean-Marc Lopez, filed Dec. 13, 2010; U.S. patent application Ser. No. 13/084,025, entitled "Active Control for the Autonomous Valve," to Fripp, filed Apr. 11, 2011; and U.S. Patent Application Ser. No. 61/473,699, entitled "Sticky Switch for the Autonomous Valve," to Fripp, filed Apr. 8, 2011.

Persons of skill in the art will recognize various combinations and orders of the above described steps and details of the methods presented herein. While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

It is claimed:

1. A method of treating a subterranean well having a wellbore extending through a formation having a plurality of production zones, the method comprising the steps of:

1) running into the wellbore a work string having an interior passageway for flowing fluid within the work string, the work string having a plurality of longitudinally-spaced screen assemblies positioned thereon;
2) positioning a first screen assembly adjacent a corresponding first target zone of the formation;
3) isolating a plurality of target zones;
4) closing a first work string valve positioned in the interior passageway of the work string, and blocking fluid flow through the interior passageway;
5) flowing fluid from the interior passageway through a first injection valve and into the corresponding first target zone;
6) closing the first injection valve by increasing a fluid pressure differential across the first injection valve, and thereby blocking fluid flow from the interior passageway into the formation;
7) opening the first work string valve and allowing fluid flow along the interior passageway;
8) repeating steps 4) through 7) above but with respect to a second work string valve, a second screen assembly and corresponding second target zone, and a second injection valve.

2. A method as in claim 1, wherein step 3 further comprises isolating a plurality of target zones using a plurality of packers.

3. A method as in claim 2, wherein the packers are swellable packers.

4. A method as in claim 2, wherein at least one packer is positioned uphole and downhole from each target zone.

5. A method as in claim 2, wherein the packers are set with work string pressure.

6. A method as in claim 1, wherein step 6 further comprises the step of closing the first work string valve by increasing fluid pressure in the interior passageway of the work string.

7. A method as in claim 1, wherein step 6 further comprises the step of moving a ball onto a ball seat to block fluid flow through the first work string valve.

8. A method as in claim 7, wherein the step of moving the ball further includes dropping the ball into the interior passageway of the work string.

9. A method as in claim 7, further comprises the step of moving the ball onto a ball seat to block fluid flow through the second work string valve.

10. A method as in claim 9, further comprising the step of raising fluid pressure in the interior passageway of the work string to open the second work string valve after the step as in claim 10.

11. A method as in claim 10, further comprising the step of shifting the ball seat longitudinally and expanding the ball seat radially to a diameter larger than the ball diameter.

12. A method as in claim 11, wherein the ball seat comprises a collet assembly.

13. A method as in claim 1, wherein step 5 further comprises the step of acidizing the formation.

14. A method as in claim 1, further comprising the step of producing hydrocarbon-bearing fluid from the wellbore.

15. A method as in claim 14, further comprising the step of producing hydrocarbon-bearing fluid from the wellbore between steps 2 and 3.

16. A method as in claim 1, wherein step 6 further comprises the step of restricting fluid flow through a flow control device into a chamber on one side of the first injection valve and providing fluid communication with relatively less restriction from the interior passageway into a second chamber on the opposite side of the first injection valve.

17. A method as in claim 16, wherein the flow control device is one of a nozzle, an autonomous inflow control device, or a flow choke.

18. A method as in claim 1, further comprising the step of opening a plurality of remotely operated remote-open valves associated with the plurality of screen assemblies.

19. A method as in claim 18, further comprising the steps of increasing fluid pressure in the interior passageway and then decreasing fluid pressure in the interior passageway to open the remotely operated remote-open.

20. A method as in claim 18, wherein the remote-open valves are one of a check valve, a rubber sleeve valve, a piston activated by a swellable material, or a time degradable plug.

* * * * *